US007223048B1

(12) United States Patent
Greer et al.

(10) Patent No.: US 7,223,048 B1
(45) Date of Patent: May 29, 2007

(54) PERFORMED PAVEMENT WARNING ASSEMBLY METHOD

(75) Inventors: Robert W. Greer, Lexington, NC (US); Christopher J. Corbett, Climax, NC (US)

(73) Assignee: Flint Trading, Inc., Thomasville, NC (US)

( * ) Notice: Subject to any disclaimer, the term of this patent is extended or adjusted under 35 U.S.C. 154(b) by 0 days.

(21) Appl. No.: 11/638,256

(22) Filed: Dec. 13, 2006

Related U.S. Application Data

(62) Division of application No. 11/401,125, filed on Apr. 10, 2006, now Pat. No. 7,189,025.

(51) Int. Cl.
*E01C 23/03* (2006.01)

(52) U.S. Cl. ..... 404/77; 404/79

(58) Field of Classification Search ..... 404/18, 404/19, 77, 79

See application file for complete search history.

(56) References Cited

U.S. PATENT DOCUMENTS 5,302,049 A * 4/1994 Schmanski ..... 404/42
5,320,790 A * 6/1994 Lowe ..... 264/31
5,759,928 A 6/1998 Harper ..... 442/337
6,499,910 B1 * 12/2002 Grahmbeek et al. ..... 404/75
6,861,141 B2 3/2005 Buccellato et al. ..... 428/355
6,951,435 B1 * 10/2005 Fennessy, Sr. ..... 404/75
6,960,989 B1 * 11/2005 Grayson ..... 340/407.1
6,971,818 B1 * 12/2005 Schabacker ..... 404/19
7,142,095 B1 * 11/2006 Grayson ..... 340/407.1
7,189,025 B1 * 3/2007 Greer et al. ..... 404/19

* cited by examiner

*Primary Examiner*—Gary S. Hartmann

(57) ABSTRACT

A detectable pavement warning assembly includes a web having a plurality of projections attached to one another by linear connectors, a planar cover with a series of apertures for receiving the projections therethrough and an adhesive sheet. In use a rigid substrate such as a sidewalk is selected, and a primer is applied. The web, cover and adhesive sheet all pre-assembled are placed on the primed substrate. Next, the warning assembly is heated with an open flame to soften and fuse the pavement warning assembly with the primed substrate. The projections will remain extended sufficiently above the cover to provide a warning to pedestrians that walk thereon, such as when approaching a traffic area or other hazard.

13 Claims, 5 Drawing Sheets

PERFORMED PAVEMENT WARNING ASSEMBLY METHOD

This is a divisional application of and claims benefits under prior application Ser. No. 11/401,125 filed 10 Apr. 2006, now U.S. Pat. No. 7,189,025.

FIELD OF THE INVENTION

The invention herein pertains to pavement markers and particularly pertains to a multi-layer detectable pavement warning assembly, method of application and primer composition for adhering the pavement warning assembly to a rigid substrate to inform visually impaired pedestrians that they are approaching a dangerous traffic pattern.

DESCRIPTION OF THE PRIOR ART AND OBJECTIVES OF THE INVENTION

Various types of warning assemblies and the like have been used over the years to warn pedestrians of approaching hazards such as curbs or crosswalks when walking along sidewalks or walkways. Usual pavement markings convey information to pedestrians by providing exposed visible, reflective and/or tactile indicia upon a traffic or walking substrate. In the past such a function was typically accomplished by painting a substrate, but this could not be seen by visually impaired individuals. In more recent years polymeric sheets have been formed with small raised domes or projections which can be sensed through the shoes of pedestrians as they walk thereon to warn of approaching hazards to prevent missteps, falls and possible bodily injury. Modern pavement marking materials offer significant advantages over paint such as dramatically increased visibility and/or retroreflectance, improved durability, and include removable marking options. Examples of modern pavement marking materials or warning assemblies are thermoplastic pavement marking sheet materials, tapes, raised pavement markers, and various pedestrian detectable warning assemblies. The placement of such warning assemblies are for example, at or near a curbside, warn pedestrians to be careful when stepping up or down, as when stepping into a crosswalk of a roadway or street. Such prior pavement warning assemblies are generally adhered to the underlying crosswalk substrate with the use of adhesives which may be solvent or heat activated though such warning assemblies may be adhered through high temperature fusion.

Detectable pavement warning assemblies are typically placed on curb ramps in which the curb has been eliminated at a crosswalk as a cue for visually impaired individuals. The elimination of the curb aids wheelchair bound persons in entering a traffic pattern, such as a crosswalk. In order to maintain a cue for the visually impaired, pavement warning assemblies are utilized to inform individuals of dangerous traffic areas.

The Americans with Disabilities Act of 1990 (ADA) published requirements for sidewalk and other potentially dangerous areas for which detectable warning devices or assemblies would be required to warn blind or visually impaired and wheelchair bound individuals of potentially dangerous and vehicular traffic areas. Of particular note is section 4.29, §§.2:

4.29 Detectable Warnings 4.29.2 Detectable Warnings on Walking Surfaces. Detectable warnings shall consist of raised truncated domes with a diameter of nominal 0.9 in (23 mm), a height of nominal 0.2 in (5 mm) and a center-to-center spacing of nominal 2.35 in (60 mm) and shall contrast visually with adjoining surfaces, either light-on-dark, or dark-on-light. The material used to provide contrast shall be an integral part of the walking surface. Detectable warnings used on interior surfaces shall differ from adjoining walking surfaces in resiliency or sound-on-cane contact.

4.29.3 Detectable Warnings on Doors to Hazardous Areas.

4.29.4 Detectable Warnings at Stairs.

4.29.5 Detectable Warnings at Hazardous Vehicular Areas. If a walk crosses or adjoins a vehicular way, and the walking surfaces are not separated by curbs, railings, or other elements between the pedestrian areas and vehicular areas, the boundary between the areas shall be defined by a continuous detectable warning which is 36 in. (915 mm) wide, complying with 4.29.2.

4.29.6 Detectable Warnings at Reflecting Pools. The edges of reflecting pools shall be protected by railings, walls, curbs, or detectable warnings complying with 4.29.2.

Detectable warning assemblies or devices may be constructed as preformed thermoplastic, thermosetting, rubber, adhesive tile, tile cast into concrete, metal, or other suitable materials that will withstand abrasion and environmental extremes. Such assemblies are typically applied in a multi-step process, sometimes involving days to weeks of preparation and application time. Many of these assemblies are rigid and difficult to retrofit to contoured curb ramps. Thermoplastic warning assemblies require either a multi-step process involving an adhesive and a detectable thermoplastic warning assembly in which the geometry of raised projections is ill-defined as the projections are made of the same materials as the adhesive. A multi-step application for thermoplastic warning assemblies is required because the assemblies are often heated to flow into the pavement or other substrate to establish a bond. Because of this flow, the truncated domes or projections required by the ADA will also flow and loose their geometry. In the so-called two-step process, a separate adhesive layer and warning layer are composed of different materials and applied to a substrate at different times. One deficiency of such process is that after heating the adhesive layer on the substrate precise timing is required for placing the detectable warning device on the molten adhesive. If too much time is taken allowing the adhesive to cool an insufficient bond is established between the detectable warning device and the adhesive layer.

Formulations for prior preformed thermoplastic detectable pavement warning assemblies, markings and traffic control devices generically comprise:

A) Binder (~20%) containing:

1) Resin:
- Maleic modified resin ester
- C5 hydrocarbon, (for hydrocarbon class)
- Rosin ester (for alkyd class)
  - Plasticizer
  - Vegetable oils
  - Phthalate esters
  - Mineral oil
  - Castor oil
  - Wax/Flexibilizer
  - Paraffin wax
  - Polyamide
  - EVA or SBS elastomers 2) Pigment (2–10%)
- Titanium dioxide
- Lead chromate
- Organic dyes 3) Filler (0–40%)
- Calcium carbonate, and B) Glass beads (0–50%)

wherein the thermoplastic warning assembly may by alkyd or hydrocarbon based and includes a hot melt thermoplastic adhesive. The warning assembly must meet the standard specifications as published in the AASHTO—(American Association of State Highway Transportation Officials)—Designation: M 249-98

In order to fulfill their function as indicia, detectable warning assemblies must be applied to rather troublesome traffic surfaces. These surfaces vary widely in terms of properties because they may be concrete or asphalt, may be of varying age and temperature, and may, on occasion, be moist, damp or oily. Additionally, the surface may vary in texture from rough to smooth. The surface properties therefore represent a considerable challenge for attachment of the detectable warning assemblies.

Specifically the standard for thermoplastic warning assemblies bond strength can be found in ASTM D4796-(2004), which states the test method and bonding strength of thermoplastic warning assemblies to concrete as: Bond Strength—After heating the thermoplastic material for four (4) hours at 425 degrees F. the bond strength to portland cement concrete shall exceed 1.24 MPa (~180 psi). Preferably the bond strength is from about 200 psi to about 500 psi.

Thermoplastic warning assemblies therefore must reach a softening point within a range of about 100 degrees C. (212 degrees F.) to about 125 degrees C. (257 degrees F.) as determined by the ring and ball softening point test method specified in AASHTO Designation: T 250-97, section 12 which is ASTM D36-95(2000)e1, "Standard Test Method for Softening Point of Bitumen (Ring-and-Ball Apparatus)".

Generally, the application of the preformed thermoplastic warning assembly requires that the concrete substrate be cured minimally from about 8 days to about 21 days before the application of the thermoplastic warning assembly with some warning assemblies requiring up to six months curing time. Most preformed thermoplastic assemblies require the concrete substrate to be pre-heated to bring the concrete surface to a required temperature prior to application of the warning assembly. The warning assembly is then heated over the pre-heated concrete to melt the thermoplastic warning assembly into the porous surface of the concrete substrate.

When the selected site for the thermoplastic warning assembly is new concrete, the thermoplastic warning assembly application presently adds days to the completion of the project in that the application of thermoplastic detectable warning assemblies, pavement markers, etc. must have a cured surface which to adhere. In most concrete pedestrian traffic areas the concrete is ready for pedestrian traffic in about 72 to 96 hours. Thus the thermoplastic warning assembly requires greater curing time for permanent application thereby leaving the traffic area non-ADA compliant until the concrete is completely cured.

Laitance (residual from the concrete curing process) on the concrete surface must be removed and cleaned prior to application of the thermoplastic warning assembly. Such residuals are cleaned from the concrete surface via grinding or high pressure washing, leaving the concrete surface wet. Most warning assemblies and adhesives require a clean dry surface for best adhesion.

While prior single layer pavement warning devices are useful in certain circumstances, a single layer warning device does not allow easy variation in the type, size or height of the projections. Further, a single layer warning device is more difficult to properly adhere to the rigid base substrate if the substrate is irregular, uneven or not level.

Thus, in view of the problems and disadvantages associated with prior art pavement warning assemblies and devices, the present invention was conceived and one of its objectives is to provide a multi-layer detectable pavement warning assembly for use on concrete sidewalks and other rigid substrates which is composed of three (3) independent polymeric layers and a substrate primer.

It is still another objective of the present invention to provide a multi-layer detectable pavement warning assembly which includes a cover, web and a bottom adhesive sheet.

It is still another objective of the present invention to provide a multi-layer detectable pavement warning assembly in which the web includes a plurality of projections which are joined by relatively thin connectors.

It is yet another objective of the present invention to provide a multi-layer detectable pavement warning assembly which includes an apertured planar cover formed from a polymeric material.

It is yet a further objective of the present invention to provide a multi-layer detectable pavement warning assembly in which the projections of the web are positioned within and extend above the apertures of the planar cover.

It is still a further objective of the present invention to provide a pre-assembled multi-layer detectable pavement warning assembly in which the cover, web, and adhesive sheet are melted and fused to a primed, rigid substrate by applying heat without the need of completely curing the substrate, removing the laitance, preheating or drying the rigid surface.

It is still another objective of the present invention to avoid the old two-step process in which an adhesive layer is first applied to the substrate and then the pavement warning layer is applied over the adhesive layer within a narrow time range.

It is yet another objective of the present invention to provide an efficient method for attachment of a multi-layer detectable pavement warning assembly without requiring either a dry concrete substrate or laitance removal to establish a strong bond.

It is also an objective of the present invention to provide a method for adhering a multi-layer detectable pavement warning assembly which can be applied in a single step to a primed, rigid substrate.

Various other objectives and advantages of the present invention will become apparent to those skilled in the art as a more detailed description is set forth below.

SUMMARY OF THE INVENTION

The present invention relates to a multi-layer detectable pavement warning assembly and method of application to a substrate. The warning assembly is an integrated multi-layer heterogeneous thermoplastic such as a silicone rubber, hydrocarbon or alkyd based composition which is adhered to a primed, bituminous or portland concrete substrate to aid visually impaired pedestrians that they are approaching a dangerous traffic area.

The concrete substrate may be primed prior to applying the pavement warning assembly by a commercially available low viscosity polyurea-epoxy or other primer. The multi-layer detectable pavement warning assembly is then placed over the primed substrate which may not be fully cured such as uncured concrete and is heated to a sufficient temperature to allow the thermoplastic warning assembly to flow into the porous, primed concrete to reactively bind the warning assembly to the concrete.

Preferably the concrete has been poured and shaped from about 24 to 48 hours before the selected primer, either as a one-part or a two-part composition, such as a moisture curable epoxy primer is applied. Longer periods than 48 hours are also applicable depending on the cure rate of the concrete and the moisture content in the surrounding soil, though some concrete substrates remain moist through their lifetimes.

Within about 20 minutes of applying, such as by brushing or spraying the polyurea-epoxy primer onto the concrete substrate or from about 1 minute to about 60 minutes depending on the ambient temperature, the multi-layered warning assembly (comprising a cover layer, a webbed layer and an adhesive layer) is applied over the polyurea-epoxy primer. Heat is then applied to raise the temperature of the warning assembly from about 400 degrees F. to about 425 degrees F. The viscosity of the polyurea-epoxy primer when first applied to the partially cured concrete is from about 100 to 300 centipoise to allow adequate penetration of the primer into the concrete substrate.

The present invention utilizes a multi-layered detectable pavement warning assembly composed of at least three layers including: (1) a webbed layer containing a plurality of interconnected truncated domes or projections aligned in rows and columns having an outside rectangular border; (2) a planar cover or top layer having apertures for receiving the projections of the webbed layer; and (3) a thermoplastic adhesive layer, preassembled at the factory. By using a top planar cover, a webbed layer and an adhesive layer, the precision required for the old so-called two-step process of first applying an adhesive layer to the substrate, heating the adhesive layer and then at a precise time applying the detectable warning assembly is avoided and simplified. In the preferred method of the invention, the adhesive layer and planar cover layer are composed of a thermoplastic material that will respond to heating by flowing and bonding with each other and the underlying substrate. The webbed layer is a thermosetting plastic material containing a plurality of projections capable of being exposed to the direct heat during application without significantly degrading.

The present invention utilizes a standard low viscosity polyurea-epoxy primer of about 100 to 300 centipoise which allows rapid penetration into the pores of concrete substrates. Standard polyurea primers or compositions of this specified viscosity will penetrate any present moisture and pass into the concrete substrate before curing, thereby providing superior attachment of the warning assembly.

The curative agents for the polyurea-epoxy primer may include conventional amine-terminated chain extenders in the formulation. Suitable chain extenders include, but are not necessarily limited to conventional aliphatic, aromatic and cycloaliphatic diamine chain extenders.

Known polyurea primers may be comprised of one-part, two-part or more part systems that may be premixed or blended on site and may remain in a liquid state (known as pot life) from seconds to many hours. Preferably the preferred low viscosity polyurea-epoxy primer will remain viable from about 1 minute to about 60 minutes to provide a relatively long window for application of the pavement warning assembly.

In addition to usual polyurea-epoxy primers, other curable primer systems of a sufficiently low viscosity to penetrate the concrete surface may be selected from the group consisting of standard one- and two-part epoxies, multi-component polyurethanes, silicones, UV/EB curable resins and combinations thereof.

Portland cements are hydraulic cements that set and harden through a chemical reaction with water. During this hydration action, a node generally forms on the surface of each cement particle. The node grows and expands until it links with nodes from other cement particles or adheres to adjacent aggregates. It is usually during hydration that the applied low viscosity polyurea-epoxy primer best seeps into (penetrates and saturates) and is chemically, reactively bonded to the concrete. The multi-layered detectable pavement warning assembly can then be placed over the polyurea-epoxy primed concrete substrate and raised to a predetermined temperature of 400 to 500 degrees F. to melt: 1) the thermoplastic top planar layer and 2) the adhesive layer into a semi-homogeneous mixture, thereby creating a chemically reacted (bonded) warning assembly with the thermosetting plastic webbed layer sandwiched there-between.

Heating of the primer on the base surface or substrate if required (such as the sidewalk) and pavement warning assembly may be accomplished by a Flint 2000EX heat gun, manufactured by Flint Trading, Inc. of Thomasville, N.C. Standard open flame, closed flame, heated rollers, electrically resistive heaters or other conventional heaters may also be used. The application of cool water such as by pouring or spraying after heating will hasten solidification, strengthening and curing of the pavement warning assembly.

DETAILED DESCRIPTION OF THE PREFERRED EMBODIMENTS AND OPERATION OF THE INVENTION

Figure 1:
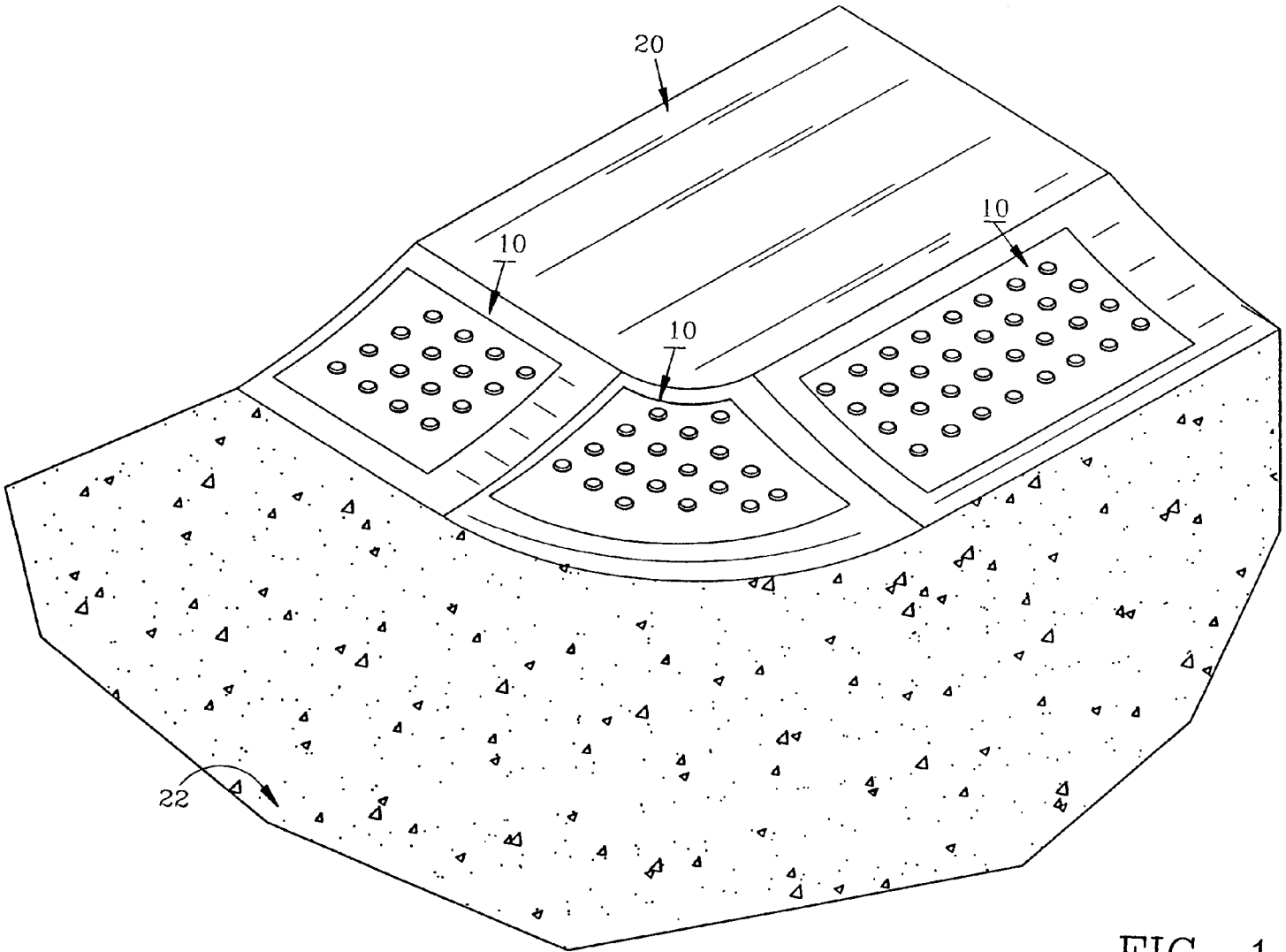
FIG. 1 shows a partial view of a typical roadway intersection and sidewalk thereat with three preferred pavement warning assemblies affixed atop the sidewalk proximate the roadway.

For a better understanding of the invention and its method of application to a substrate, turning now to the drawings, FIG. 1 schematically illustrates a typical fragmented sidewalk section 20 as formed from concrete with a height of approximately four (4) inches (10.2 cm) which slopingly abuts roadway 22 at a typical corner or intersection. Preferred detectable pavement warning assemblies 10 are shown positioned in three (3) locations to provide tactile warnings to pedestrians, such as visually impaired pedestrians as they walk across warning assemblies 10 to roadway 22. One or more pavement warning assemblies 10 may be utilized in a typical installation.

Figure 2:
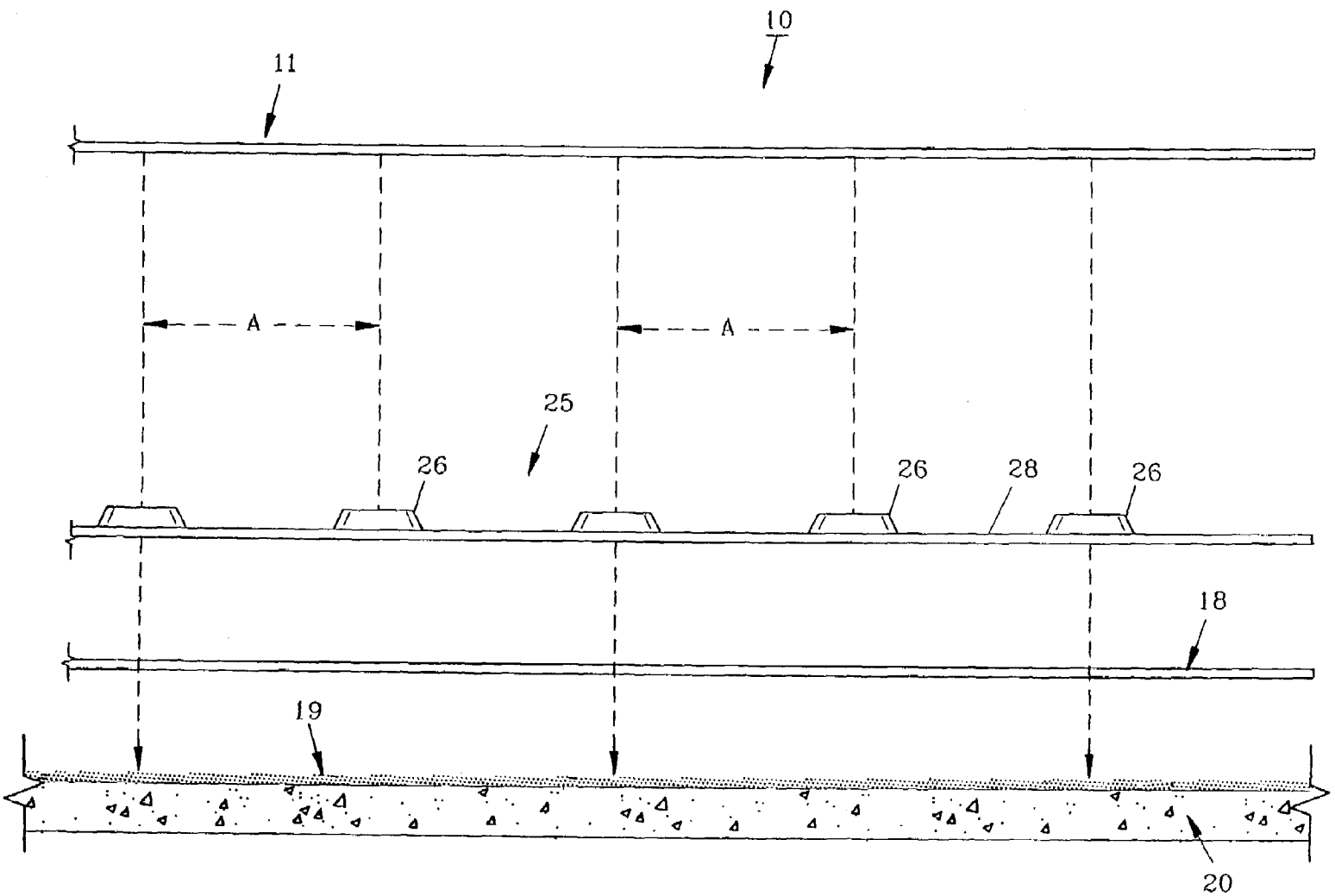
FIG. 2 depicts a side elevational view showing three layers of the preferred pavement warning assembly in exploded fashion above the primed concrete substrate.

Preferred pavement warning assembly 10 includes planar top layer or cover 11, web 25 and bottom adhesive layer 18 as seen exploded in FIG. 2 prior to assembly and installation on sidewalk section 20 having a standard polyurea-epoxy primer 19 thereon. Cover 11 is formed by conventional stamping of a planar thermoplastic, which may be hydrocarbon or alkyd. Cover 11 has a thickness range of about 1.5–2.3 mm with a length of approximately 610 mm and a width of approximately 305 mm although such dimensions are only representative and may be varied depending on the particular materials selected, the traffic count at the selected location and other factors as desired by the manufacturer, supplier or installer. Round or circular apertures 12 (see FIG. 3) formed in cover 11 during stamping are preferably spaced at 61 mm intervals (center to center) as shown by arrow A (FIGS. 2–5) to accommodate the spacing of truncated domes or projections 26 of preferred molded web 25 seen in FIGS. 2 and 4. Examples of formulas for a hydrocarbon or non-hydrocarbon thermoplastic which may be used for either cover 11 or adhesive 18 are seen below:

| Hydrocarbon thermoplastic formula: | |
|---|---|
| C5 hydrocarbon resin** | 12% |
| Refined Mineral oil | 3% |
| EVA (ethylene vinyl acetate)*** | 3% |
| Glass beads* | 30% |
| Titanium dioxide ($TiO_2$) | 10% |
| $CaCo_3$ | 42% |
| | 100% |

*manufactured by Potters Industries of Valley Forge, Pennsylvania 19482
**manufactured by Goodyear Chemical, Akron, Ohio 44306
***manufactured by Dow Chemical Company, Gales Ferry, Connecticut 06335

| Non-Hydrocarbon thermoplastic formula: | |
|---|---|
| Phthalate Plasticizer | 3.0% |
| Alkyd resin** | 8.0% |
| PE based wax | 2.0% |
| Polyamide resin, Arizona Chemical | 7.0% |
| Fumed silica*** | 0.5% |
| Calcium Carbonate | 39.5% |
| AASHTO Type 1 glass beads* | 30.0% |
| TiO2, Rutile | 10.0% |
| | 100.0% |

*AASHTO Type 1 beads as manufactured by Potters Industries of Valley Forge, Pennsylvania 19482
**manufactured by Arizona Chemical, located in Jacksonville, Florida 3225
***manufactured by U.S. Composites of West Palm Beach, Florida 33405

Figure 4:
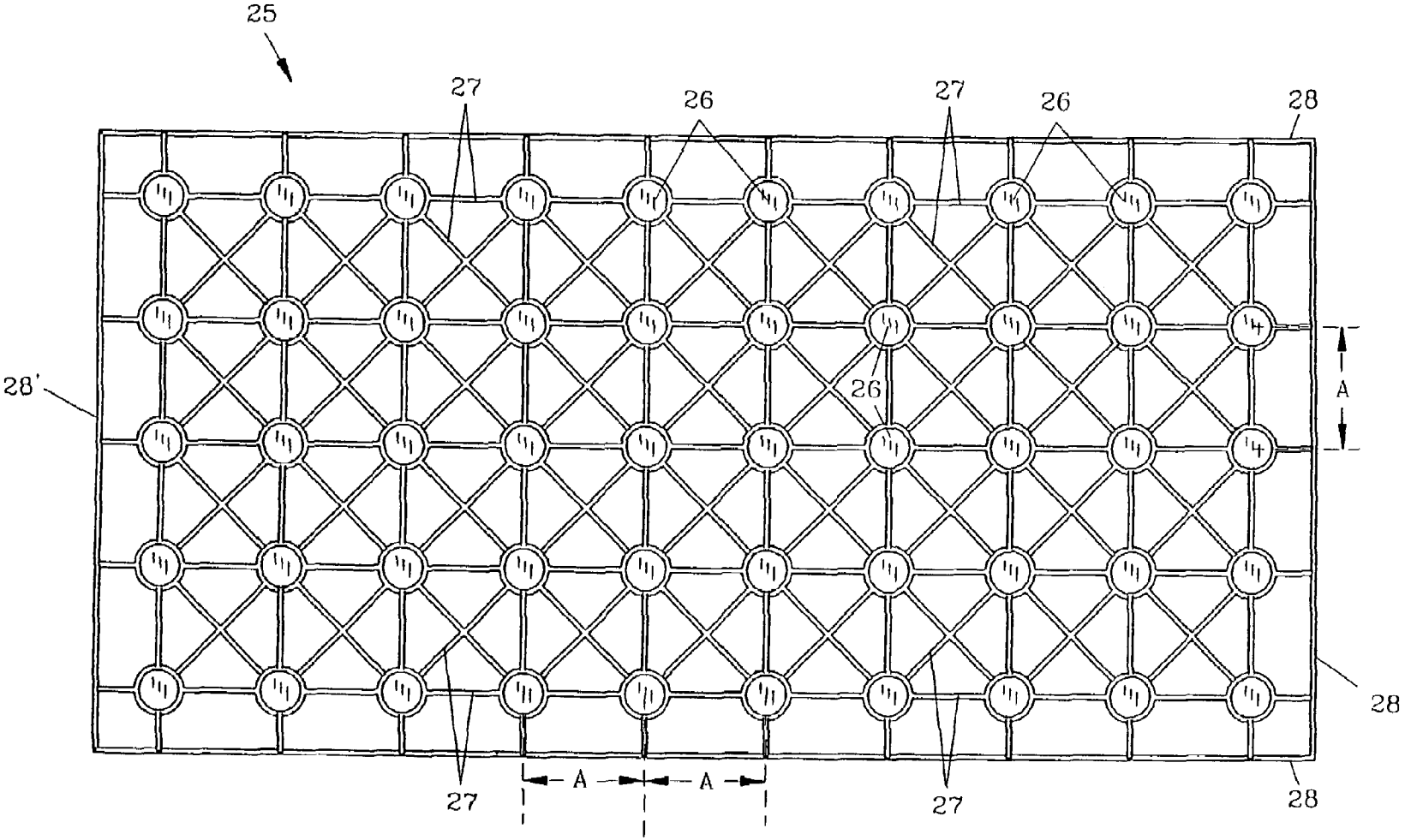
FIG. 4 pictures a top plan view of the preferred form of the webbed layer.
Figure 5:
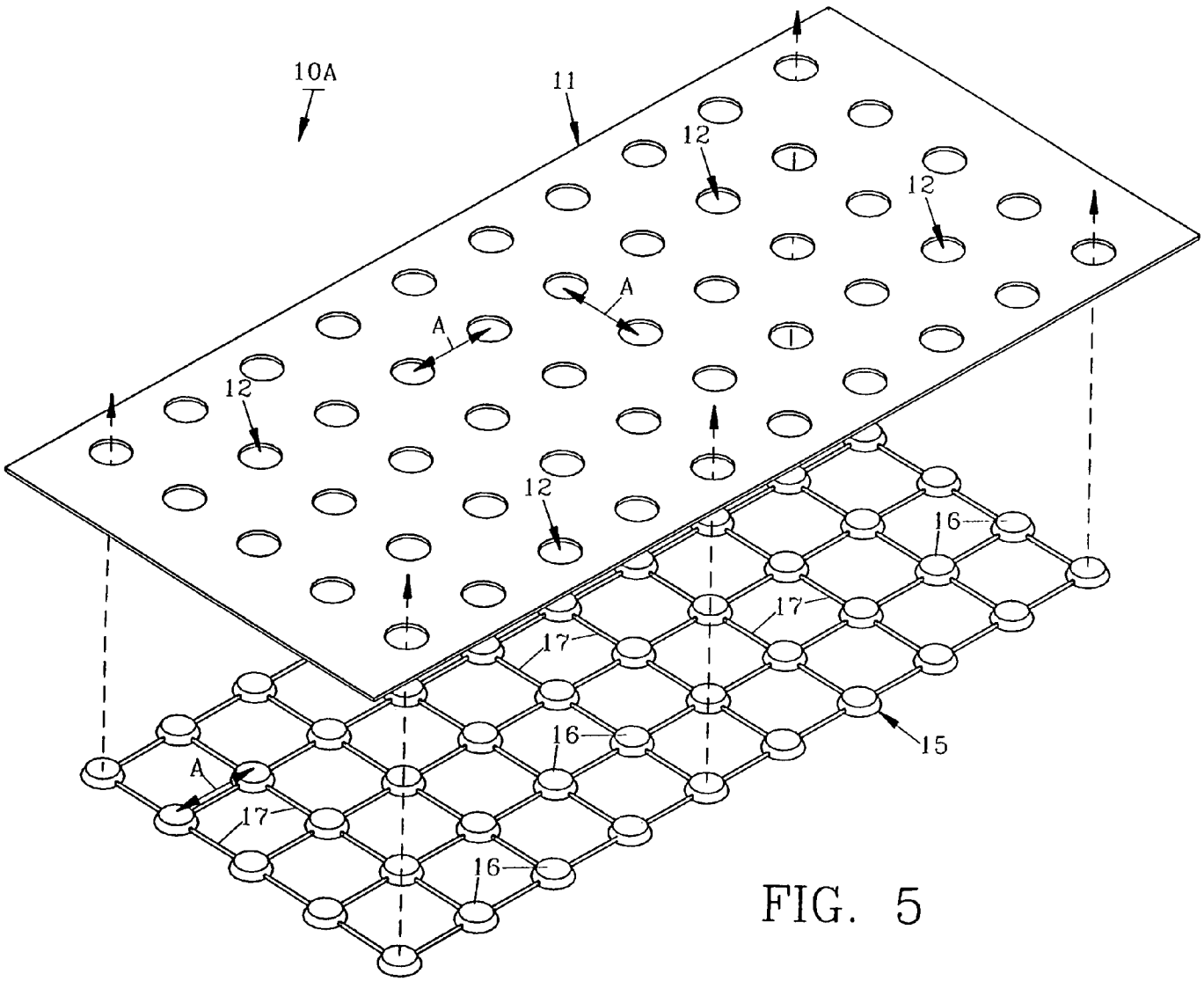
FIG. 5 demonstrates an exploded view of an alternate pavement warning assembly cover and webbed layer without the adhesive layer.

As seen in FIG. 4 preferred web 25 comprises a plurality of projections 26 connected by linear connectors 27 and includes side borders 28, 28 and end borders 28', 28' forming a rectangle. As would be understood, projections 26 are likewise spaced on 61 mm centers for reception by apertures 12 in cover 11 as seen for example in FIG. 5 with alternate web embodiment 15. Linear connectors 27 are illustrated between projections 26 and are integral therewith in the preferred embodiment of web 25 which is formed by conventional liquid injection molding techniques from a cured thermosetting silicone rubber, preferably KEG-2000-70, also manufactured by Shin-Etsu Chemical Co., Ltd. of Tokyo, Japan which does not melt during the assembly and installation process.

In certain circumstances, alternate web embodiment 15 and web 25 may be formed of either a standard thermosetting material or thermoplastic resins but such is not preferred. If a thermoplastic material is used to make web 25 it must have a higher melting temperature than the melting temperature of cover 11 and adhesive 18 to prevent distortion during heating. Webs 15, 25 may also have connectors 27 formed from a nylon thermoplastic composition and projections 26 formed from a silicon polymer. Standard pigments may be added to the selected formulation to obtain a desired color for projections 26. Also, for reinforcing purposes web 25 may include conventional chopped glass fibers in the range of 4–35 microns in diameter.

Adhesive layer 18 as shown in FIG. 2, like cover 11 is a thermoplastic hydrocarbon or alkyd formulation of substantially the same dimensions and thickness as cover 11.

During the application to sidewalk 20, cover 11, web 25 and adhesive layer 18, which are pre-assembled, are positioned on sidewalk 20 and heat from conventional hand held heat gun 30 (seen schematically in FIG. 3) is applied to fuse cover 11 and adhesive layer 18 with web 25 sandwiched therebetween while at the same time adhering warning assembly 10 to sidewalk section 20 (FIGS. 1 and 2) having preferred standard polyurea-epoxy primer 19 thereon. Web 25 does not melt and is simultaneously fused between and to cover 11 and adhesive layer 18 during the heating step just described. Alternate web layer 15 seen in FIG. 5 having projections 16 and connectors 17 could likewise be used as shown in warning assembly 10A. While the preferred adhesive layer shown is thermoplastic material a standard thermosetting plastic may also be used provided it meets the requirements of the particular application.

In the preferred method of use, a selected site for placement of pavement warning assembly 10 is chosen, such as sidewalk section 20 seen in FIG. 1. Concrete sidewalk section 20 is then coated by brushing with primer 19. Cover 11, web 25 and adhesive layer 18 are pre-assembled as detailed above and placed over the primed substrate, whereby heat from heat gun 30 is then applied to fuse and adhere warning assembly 10 onto primed sidewalk section 20. Heat is applied to raise the temperature of warning assembly 10 to 400–500 degrees F. and preferably to about 425–450 degrees F. Optionally water (not shown) may be applied by spraying to cool fused warning assembly 10. Standard heat gun 30, preferably such as sold by Flint Trading, Inc. of Thomasville, N.C. under the name Flint 2000EX, is an open flame type. Certain closed flame or heated roller types, electric heaters or other heaters may also be used. Heat gun 30 is then removed and thermoplastic warning assembly 10 is allowed to cool, returning heated layers 11, 25 and 18 to a hardened state. Once cool, warning assembly 10 is unitary with concrete substrate (sidewalk section 20) and primer 19.

Figure 3:
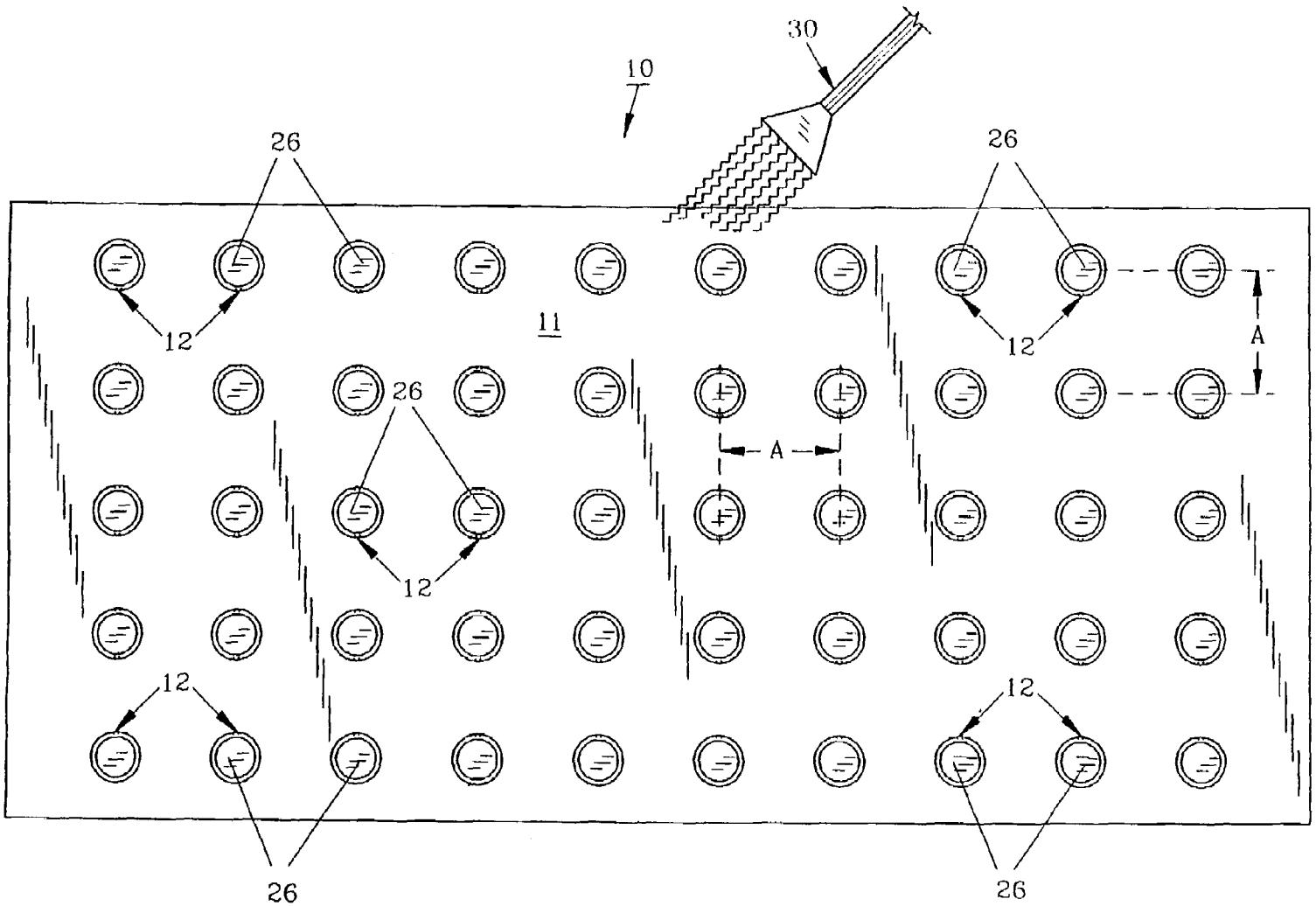
FIG. 3 illustrates a top plan view of one pavement warning assembly as shown in FIG. 1 with the projections extending therethrough and with heat being applied from a heat gun.

Preferred low viscosity polyurea-epoxy primer 19 used is a CCS Polyurea primer as sold by Chemco Systems of Redwood City, Calif. Other conventional thermoplastic or thermosetting primers may be used as required. Primer 19 is applied to the selected substrate site as described above by brushing. Heat from heat gun 30 can then be applied to primer 19. (Low viscosity as used herein ranges from about 10–500 cps, with a preferred range of about 100–300 cps.) During pre-assembly at the factory, truncated projections 26 of web 25 and apertures 12 of cover 11, are aligned and manually pressed together causing projections 26 to extend through and above cover 11, preferably about 5 mm. Combined cover 11 and web 25 are then aligned and pressed atop adhesive layer 18 to frictionally engage layers 11, 25 and 18. On site assembly 10 is manually pressed onto primer 19 laden sidewalk section 20. Next, heat from heat gun 30 as shown in FIG. 3 is applied to warning assembly 10 so that cover 11 and adhesive layer 18 fuse or melt together with web 25 therebetween and to fuse to underlying sidewalk section 20 having primer 19 thereon. Heat gun 30 is thereafter withdrawn and pavement warning assembly 10 is allowed to cool, with or without a water application. As would be understood, web 25 being a thermosetting material does not melt and provides an irregular surface to pavement warning assembly 10 for detection by pedestrians walking thereon as they feel raised projections 26 and proceed cautiously as they approach roadway 22 (FIG. 1).

The illustrations and examples provided herein are for explanatory purposes and are not intended to limit the scope of the appended claims.

We claim:

1. A method of affixing a pavement warning assembly having a web with projections and an apertured cover to a rigid substrate comprising the steps of:

a) placing the pavement warning assembly on the substrate with the projections extending upwardly through the apertured cover; and b) heating the pavement warning assembly to fuse the pavement warning assembly to the substrate.

2. The method of claim 1 further comprising the step of coating the substrate with a primer.

3. The method of claim 1 further comprising the step of heating the primed substrate prior to applying the pavement warning assembly thereon.

4. The method of claim 1 wherein placing the pavement warning assembly against the primed substrate comprises the step of placing the pavement warning assembly on a primer coated concrete sidewalk.

5. The method of claim 1 further comprising the step of walking on the pavement warning assembly while detecting the projections.

6. A method of affixing a pavement warning assembly having a web with projections, an apertured cover and an adhesive sheet to a rigid substrate comprising the steps of:

a) priming the substrate;

b) placing the pavement warning assembly on the primed substrate with the web projections extending upwardly through the apertured cover and the adhesive sheet beneath the web to contact the primed substrate; and c) heating the pavement warning assembly to fuse the pavement warning assembly to the substrate.

7. The method of claim 6 wherein priming the substrate comprises the step of coating the substrate with an epoxy primer.

8. The method of claim 6 further comprising the step of heating the primed substrate prior to placing the pavement warning assembly thereon.

9. The method of claim 6 wherein placing the pavement warning assembly on the primed substrate comprises the step of placing the pavement warning assembly on a primer coated concrete sidewalk.

10. The method of claim 6 further comprising the step of walking on the pavement warning assembly while detecting the projections.

11. The method of claim 6 wherein placing the pavement warning assembly comprises the step of placing a thermoplastic pavement warning assembly on the primed substrate.

12. The method of claim 6 wherein placing the pavement warning assembly comprises the step of placing a thermosetting pavement warning assembly on the primed substrate.

13. The method of claim 6 wherein heating the pavement warning assembly comprises the step of heating a pavement primed with a polyurea-epoxy.

* * * * *